US005317768A

United States Patent [19]

Klancnik

[11] Patent Number: 5,317,768

[45] Date of Patent: Jun. 7, 1994

[54] SPRING MATTRESS WITH A TOP PORTION CONTAINING FOAM AND FIBERS

[75] Inventor: Alvin R. Klancnik, Park Ridge, Ill.

[73] Assignee: Serta, Inc., Des Plaines, Ill.

[21] Appl. No.: 941,975

[22] Filed: Sep. 8, 1992

[51] Int. Cl.[5] ..... A47C 27/05; A47C 27/12; A47C 27/22

[52] U.S. Cl. ..... 5/475; 5/464; 5/481; 5/448; 5/901

[58] Field of Search ..... 5/481, 901, 900.5, 464, 5/448, 462, 475, 468

[56] References Cited

U.S. PATENT DOCUMENTS

| | | | |
|---|---|---|---|
| 4,741,058 | 5/1988 | Williams et al. | 5/901 |
| 4,955,095 | 9/1990 | Gerrick | 5/481 |
| 5,136,740 | 8/1992 | Kraft | 5/481 |

*Primary Examiner*—Alexander Grosz

*Attorney, Agent, or Firm*—Arnold, White & Durkee

[57] ABSTRACT

A mattress having a top surface component and a spring component. The top surface component comprises multiple layers. The first layer is the cover material for enveloping the entire mattress. The second layer is a fiber material covering the entire top surface of the mattress. The third layer is convoluted foam subtending the fiber layer and having a plurality of peaks for supporting the fiber layer in a no load condition. The fourth layer is a backing material for the convoluted foam layer. The peaks of the convoluted foam layer compress either completely or partially when a weight is applied and return to their original no load position when the weight is removed. The compression and return action of the peaks of the convoluted foam layer exercise the fiber layer preventing the matting thereof and cause the movement of air to keep the fiber layer dry.

1 Claim, 2 Drawing Sheets

Fig. 3

SPRING MATTRESS WITH A TOP PORTION CONTAINING FOAM AND FIBERS

FIELD OF THE INVENTION

The present invention relates to mattresses and, in particular, to the upper surface structure for a mattress. The upper surface of the mattress provides the direct contact with the sleeper and generally comprises several layers of different material frequently quilted together to present a pleasing appearance.

BACKGROUND

A mattress generally comprises a plurality of interconnected coil springs together with some border wires forming a generally rectangular structure and an upper layer including the cover or ticking which envelopes the entire structure. The upper surface provides the immediate perception of softness or "feel" for the sleeper. The upper surface frequently includes several different materials stitched together around the periphery or quilted together to provide a composite structure.

One known upper or top surface includes a layer of backing material, a layer of foam material positioned over the backing material, a layer of fiber material positioned over the foam and finally a layer of ticking forming the cover. The entire structure is stitched together around the periphery or with stitching to form a quilt pattern. A significant problem with this known upper surface is the matting of the fiber material after use. Once the fiber material becomes crushed due to a weight, it losses its resilience and no longer returns to its original position even after the weight is removed. Once this condition exists, the softness or feel of the mattress is ruined or degraded. In addition, the appearance of the mattress is spoiled with the areas of crushed fiber material appearing flat in comparison to surrounding areas. Another problem with the known top surface is the retention of moisture. During a normal sleep cycle the sleeper may perspire and this moisture is absorbed by the cover and fiber layer. Once wet, the fiber layer is slow to dry and the retained moisture can result in an unpleasant aroma. Furthermore, once the fiber layer is moist, the tendency for matting is increased.

SUMMARY OF THE INVENTION

The present invention is an upper or top surface structure for a mattress. The upper surface structure is placed on top of the general coil structure of the mattress. The top surface is the portion of the mattress that is in direct contact with the sleeper and in the preferred embodiment comprises four separate layers of material. The first layer is the cover or ticking for the mattress. The second layer subtending the first layer is a fiber or filler material. The third layer is a convoluted foam having a convoluted surface side and an opposite flat surface side, the convoluted surface side pointing upward and contacting the second fiber layer. A fourth mesh or cloth bottom or backing layer is underneath the flat surface side of the convoluted foam layer. In the preferred embodiment, all four layers are stitched together in a quilt pattern.

The convoluted foam layer has a plurality of upward facing peaks and a plurality of valleys formed between groups of adjacent peaks. In the no load position, the convoluted foam peaks support the fiber layer. When a weight is applied to the top surface, the fiber layer and the convoluted foam layer are compressed. Depending upon the weight, some of the peaks of the convoluted foam layer fully compress into the body of the foam layer while other ones of the peaks are only partially compressed. When the weight is removed the peaks of the convoluted foam layer return to their no load position moving or exercising the fiber layer back to its position overlaying the convoluted foam layer. This exercising of the fiber layer reduces matting. Furthermore, the upward movement of the peaks of the convoluted foam and the fiber layer forces air movement which dries any moisture from the fiber layer.

The use of the convoluted foam layer in the top surface also increases the comfort or softness "feel" of the mattress since the various peaks are quick to respond to a weight by compressing. This quick peak compression slows as the specific peak is compressed into the body of the convoluted foam layer. Yet the quick peak compression provides a comfort or softness "feel" particularly for bony parts of a sleeper.

In another embodiment the top surface is divided into zones and the configuration of the convoluted foam is changed from zone to zone. The top third of the mattress, which supports the head/neck/shoulder area of the sleeper, has the peak and valley convoluted foam layer as described above. The middle third of the mattress, which supports the back/buttocks area of the sleeper, uses a less resilient herringbone pattern of convoluted foam. Finally, the lower third of the mattress, which supports the leg/feet area of the sleeper, uses the peak and valley convoluted form. Thus, the portion of the mattress that supports the greatest weight has a less resilient configuration of foam and the portion of the mattress supporting the lighter but more bony body parts has a more resilient foam layer.

BRIEF DESCRIPTION OF THE DRAWINGS

Other advantages of the invention will become apparent upon reading the following detailed description and upon reference to the accompanying drawings, in which.

Figure 1:
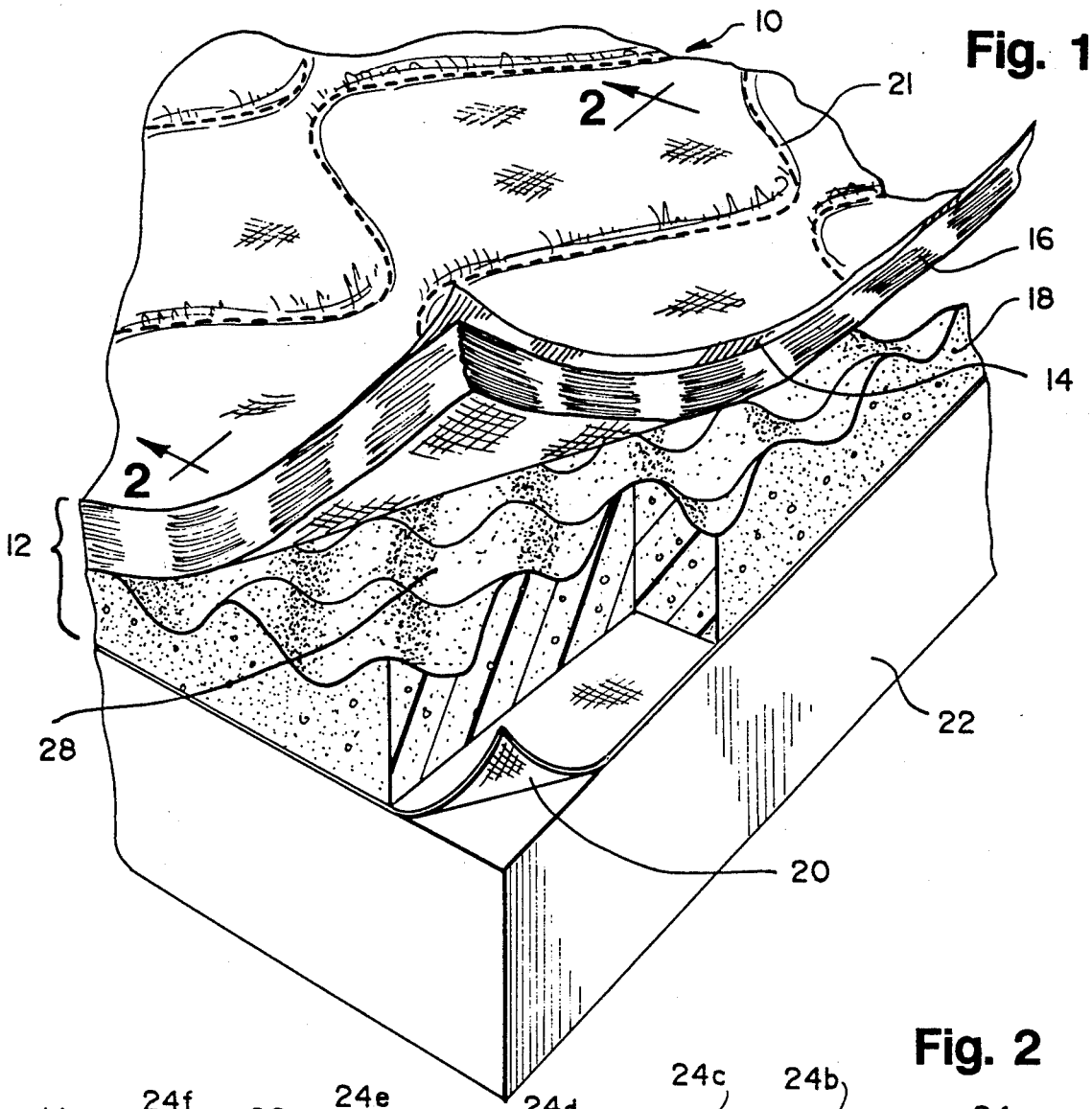
FIG. 1 is a perspective view of a portion of a mattress with the layers of the upper surface being pulled back for purposes of illustration.

While the invention is susceptible to various modifications and alternative forms, a preferred embodiment thereof has been shown by way of example in the drawings and will herein be described in detail. It should be understood, however, that the invention is not intended to be limited the particular forms disclosed. On the contrary, the applicant's intention is to cover all modifications, equivalents and alternatives falling within the spirit and scope of the invention as defined by the appended claims.

DETAILED DESCRIPTION OF THE INVENTION

Turning to the drawings wherein like reference numbers refer to the same parts throughout the figures, FIG. I is a perspective view of a mattress 10 showing each one of the four layers of the upper surface 12 pulled back for the sake of clarity. Only a small portion of the mattress 10 is illustrated, and it should be clearly understood that the various layers of the top surface extend over the entire surface of the mattress. In addition, other portions of the mattress 10 have been deleted or shown only in diagrammatical form for clarity in describing the invention. The first layer is the ticking or cover fabric 14 which as is understood by one of ordinary skill envelopes the entire mattress 10. The second layer subtending the ticking 14 is a fiber or filler layer 16. The third layer beneath the fiber layer 16 is convoluted foam 18. The convoluted foam layer 18 comprises an upper surface having a plurality of peaks and valleys regularly spaced across its entire length and width and a flat bottom surface. The fourth layer is the base or bottom cloth layer 20. This bottom layer 20 is in contact with the flat surface of the convoluted foam layer 18. All four of these layers are held in proper position by stitching 21 forming a general quilt pattern. Of course, the stitching could be done only around the periphery thereby eliminating the quilting effect. The thickness of the fiber layer 16 and the convoluted foam layer 18 are matters of design choice. In the preferred embodiment the fiber or fill is ¾ to 2 ounces per square foot of polyester fiber and the convoluted foam has a total normal height of 1¼ inches with a base of ⅝ inch and a peak height of ⅝ inch. Of course, different weight material can be used for the fiber layer 16 and different heights of foam can be used for the foam layer 18. The four layer upper surface 12 extends over the complete surface of the spring structure illustrated diagrammatically at 22. While in the preferred embodiment the foam layer 18 comprises a plurality of peaks and corresponding valleys, it should be clear to one of ordinary skill in the art that the convoluted foam layer can have any geometric shape which performs the functions as described hereinafter.

Figure 2:
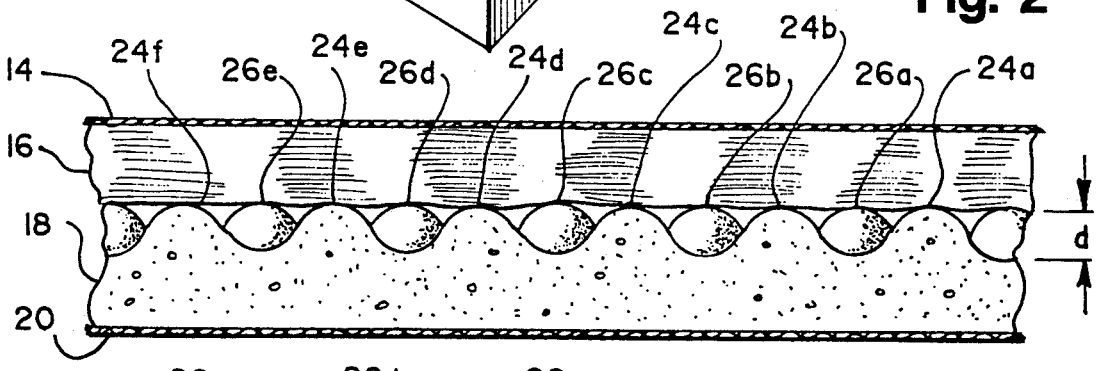
FIG. 2 is a cross section of the upper surface along line 2—2 in FIG. 1.

FIG. 2 is a cross-section along line 2—2 in FIG. 1 and clearly illustrates a first row of peaks **24*a* through 24*f* of the convoluted foam layer 18. Behind the first row of peaks 24*a*–24*f* is a second row of peaks 26*a*–26*e*. Under no load situations the fiber layer 16 rests substantially over the peaks 24*a*–24*f* and 26*a*–26*e* of the foam layer 18. The fiber layer 16 is separated from the bottom of each peak 24*a*–24*f* and 26*a*–26*e* by a distance d. The peaks 24*a*–24*f* in the first row are staggered with respect to the peaks 26*a*–26*c*, in the second row so that the areas between adjacent peaks in the first row and a peak in the second row forms a valley 28. This arrangement is best illustrated in FIG. 1**.

Figure 3:
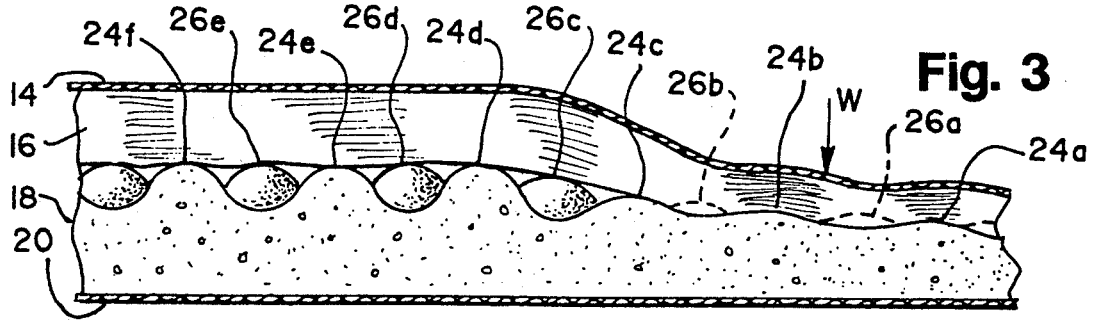
FIG 3 is a cross section of the mattress the same as FIG. 2 but with a weight being applied.

FIG. 3 is a cross-section the same as FIG. 2 but with a weight W (e.g. sleeper) forcing the various layers together. The fiber layer 16 and the foam layer 18 are generally compacted due to the weight W. The peaks 24 and 26 are substantially compressed into the foam layer 18 as illustrated at the right side of FIG. 3. The peaks **24*a*–24*f* and 26*d*–26*e* are not compressed by the weight W. Peaks 24*c* and 26*c* are shown as slightly compressed. Peaks 24*a* and 24*b* are shown substantially fully compressed while peaks 26*a* and 26*b* are shown slight compressed in dotted lines since the fiber 16 has been forced into the valley area in front of these peaks. The fiber layer 16 exhibits a tensile strength which supports the peaks 24 and 26 in the vertical direction. This support is increased when the fiber layer 16 is compressed between partially depressed peaks such as peaks 26*a* and 26*b*. Any component of the force or weight which is not perpendicular to the surface tends to roll over the peaks 24 and 26 instead of compressing the peaks, particularly if the peak height is increased. The tensile strength of the fiber layer 16 counters this non-perpendicular force and reduces any tendency for the peaks 24 and 26 to deform or roll over. When the weight W is removed, the resilient foam layer 18 returns to its original position and the upward force returns the fiber layer 16 previously compressed into the valleys 28 to its original position as shown in the no load position of FIG. 2. In this manner the fiber layer 16 is "exercised" each time a weight W is removed which greatly extends its life since the matting of the fiber does not occur. By the term "exercised", it is meant that the force of the various peaks 24 and 26, either partially compressed or fully compressed, returning to the no load condition, puns the fiber 16 out of the valleys 28 and stretches it to the original position. In addition, the compression and return action of the foam layer 18 together with the fiber layer 16 acts as a pump to circulate air through the fiber 16, helping to keep the fiber 16** dry.

The resistance to compression of peaks 24 and 26 increases as the material compressing the peak is forced into the body of the foam layer 18. Accordingly, the peaks 24 and 26 are at first easily compressed downward but the resistance to compression increases together with the downward travel. Therefore, the peaks 24 and 26 provide a high degree of comfort or softness "feel" particularly to bony protuberances of the sleeper. In other words, the relatively light touch of the sleeper's elbow will cause a slight compression on the contacted peaks 24 and 26, thereby providing a feeling of comfort or softness to the top surface 12. However, increased pressure or weight of the sleepers elbow will meet with increased resistance to depression of the peaks 24 and 26, thereby providing support for the bony body part.

Figure 4:
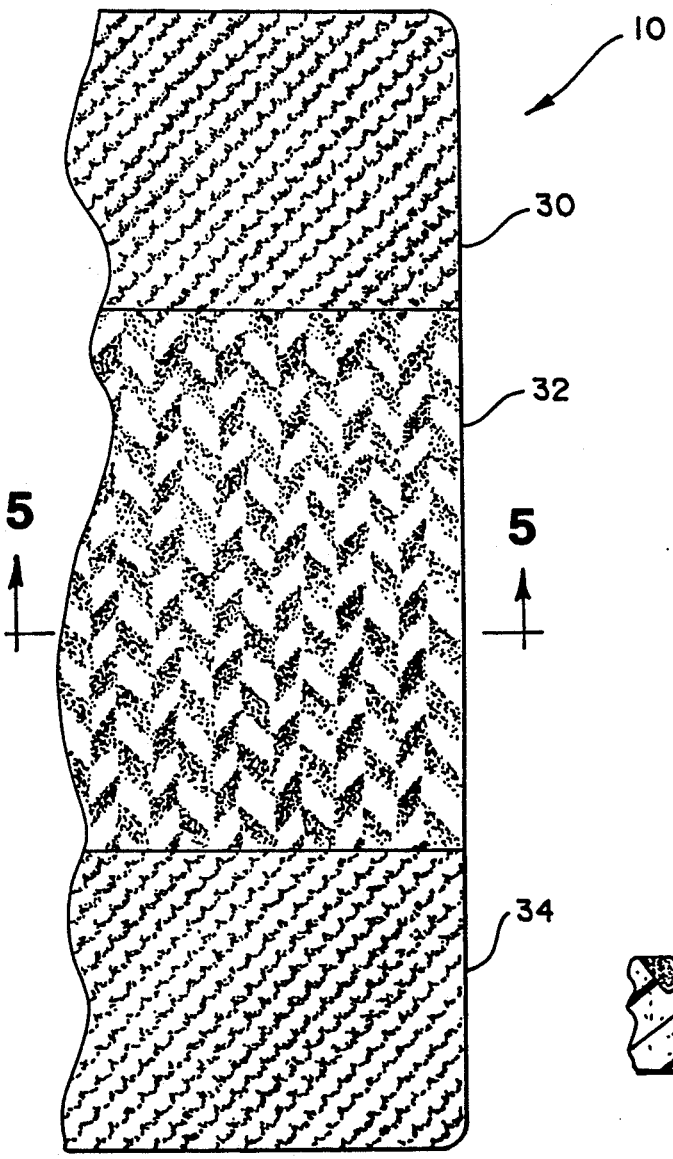
FIG. 4 is an illustration of a zoned upper surface mattress.

FIG. 4 is an illustration of a zone top surface for a mattress 10. The upper third of the top surface or zone 30 uses the peak and valley convoluted foam described above. This area or zone 30 is intended to support the head, neck and shoulder of the sleeper. The middle third of the top surface or zone 32 is intended to support the back and buttocks portion of the sleeper. This area or zone 32 uses a herringbone convoluted foam pattern. This configuration of convoluted foam has a greater resistance to compression and, accordingly, exhibits more firmness. Of course, any geometric configuration can be used for the convoluted foam pattern provided that it performs the pumping action described above. The use of the convoluted foam with greater firmness in zone 32 is done since this area has the greatest weight from the sleeper. The lower third of the top surface or zone 34 is intended to support the legs and feet of the sleeper. This area or zone 34 uses the same configuration of convoluted foam as zone 30. It should be clear to one of ordinary skill in the art that, while a three zone top surface has been described, additional zones with convoluted foam configurations having different degrees of firmness are within the scope of the present invention.

Figure 5:
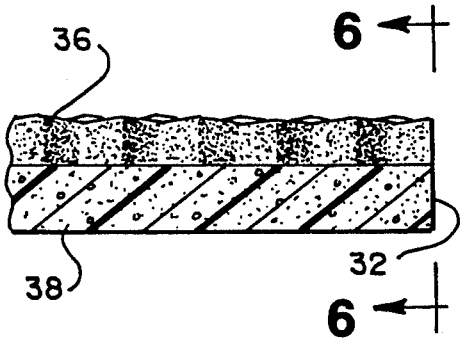
FIG. 5 is a cross section of the middle section of the top surface of the mattress in FIG. 4 along line 5—5.

FIG. 5 is a cross section of the middle area 32 of the mattress 10 in FIG. 4 along line 5—5. The herringbone pattern of the portion 32 is illustrated and, when a weight is applied, the peaks 36 are compressed downward into the base 38 are described in FIG. 3 above. The shape of the herringbone pattern tends to distribute the weight over a greater surface thereby providing a stiffer surface or greater support.

Figure 6:
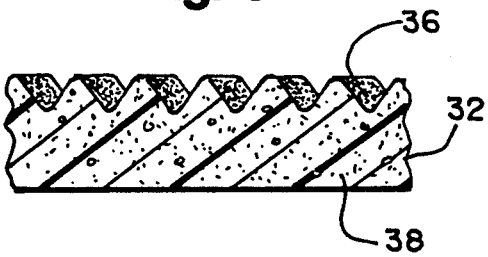
FIG. 6 is a side view of the middle section of the top surface of the mattress in FIG. 4.

FIG. 6 is a side view of the middle area 32 of the mattress 10 in FIG. 4. The peaks 36 of the herringbone pattern are illustrated together with the base 38. The length of the peaks 36 contributes to the distribution of a weight placed upon the middle area 32 as described above. Of course, the other layers, namely the top 14, the fiber layer 16 and the bottom 20 (not illustrated), cooperate with the middle area in the same manner as discussed above to obtain the same results.

A new top surface structure for a mattress has been described. The top surface comprises a cover material layer, a fiber layer, a convoluted foam layer with peaks facing upward and a fabric backing layer. In a no load condition the fiber layer rests along the top or peaks of the convoluted foam layer. Under a weight, the peaks of the convoluted foam layer are compressed into the foam layer either completely or partially. The fiber layer is forced into valleys between adjacent peaks of the foam layer that remain only partially compressed. When the weight is removed, the peaks of the foam layer return to their no load position and in doing so both exercise the fiber layer to reduce matting and circulate air to maintain the fiber layer dry.

What is claimed is:

1. A mattress comprising:

a cover material;

a fiber layer subtending at least a portion of said cover material;

a convoluted foam layer positioned under said fiber layer and having a top side and a bottom side, said top side having a plurality of peaks and said bottom side being substantially flat;

a backing layer beneath said flat bottom side of said foam layer;

said cover material, said fiber layer, said convoluted foam layer and said backing layer being secured together by stitching;

said peaks of said foam layer being completely or partially compressed when a weight is applied to the mattress and said fiber layer being forced into said valleys between partially compressed peaks;

said peaks of said foam layer returning to their original position when the weight is removed, thereby returning said fiber layer to its original position overlapping said peaks and forcing air movement through said fiber layer to keep it dry;

a spring unit subtending said backing layer; and said cover material enveloping said fiber layer, said convoluted foam layer, said backing layer and said spring unit to form a mattress.

* * * * *

US005317768B1

REEXAMINATION CERTIFICATE (3863th)

United States Patent [19] [11] B1 5,317,768

Klancnik [45] Certificate Issued Sep. 7, 1999

[54] SPRING MATTRESS WITH A TOP PORTION CONTAINING FOAM AND FIBERS

[75] Inventor: Alvin R. Klancnik, Park Ridge, Ill.

[73] Assignee: Serta, Inc., Des Plaines, Ill.

Reexamination Request:
No. 90/005,013, Jun. 10, 1998

Reexamination Certificate for:

| | |
|---|---|
| Patent No.: | **5,317,768** |
| Issued: | **Jun. 7, 1994** |
| Appl. No.: | **07/941,975** |
| Filed: | **Sep. 8, 1992** |

[51] Int. Cl.[6] ..... A47C 27/05; A47C 27/12; A47C 27/22

[52] U.S. Cl. ..... 5/736; 5/737; 5/716; 5/724; 5/727

[58] Field of Search ..... 5/716, 718, 719, 5/720, 721, 724, 727, 736, 737, 653, 654.1, 652.1

[56] References Cited

FOREIGN PATENT DOCUMENTS 593534 2/1934 Germany .

*Primary Examiner*—Alexander Grosz

[57] ABSTRACT

A mattress having a top surface component and a spring component. The top surface component comprises multiple layers. The first layer is the cover material for enveloping the entire mattress. The second layer is a fiber material covering the entire top surface of the mattress. The third layer is convoluted foam subtending the fiber layer and having a plurality of peaks for supporting the fiber layer in a no load condition. The fourth layer is a backing material for the convoluted foam layer. The peaks of the convoluted foam layer compress either completely or partially when a weight is applied and return to their original no load position when the weight is removed. The compression and return action of the peaks of the convoluted foam layer exercise the fiber layer preventing the matting thereof and cause the movement of air to keep the fiber layer dry.

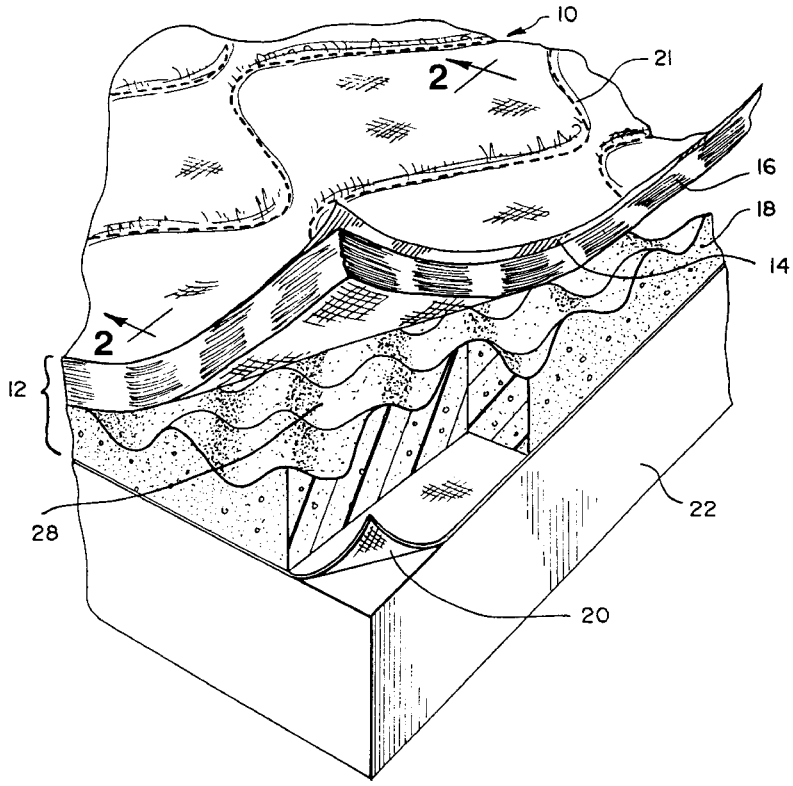

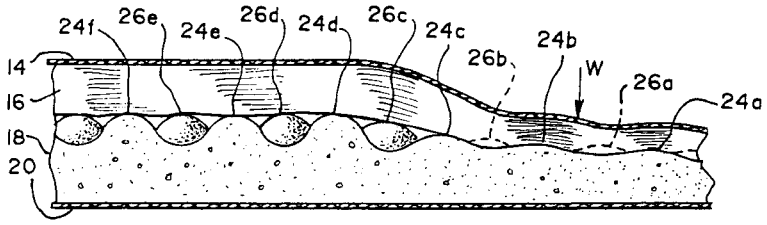

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claim 1 is confirmed.

* * * * *